United States Patent [19]

Sparrow

[11] Patent Number: 4,782,559

[45] Date of Patent: Nov. 8, 1988

[54] BUTTON COLLET AND METHOD AND APPARATUS FOR MAKING THE SAME

[75] Inventor: Timothy H. Sparrow, Harrodsburg, Ky.

[73] Assignee: Universal Fasteners, Inc., Lawrenceburg, Ky.

[21] Appl. No.: 57,038

[22] Filed: Jun. 3, 1987

[51] Int. Cl.[4] ..... A44B 1/18

[52] U.S. Cl. ..... 24/113 MP; 24/108; 29/715; 29/445; 227/15

[58] Field of Search ..... 24/104, 108, 107, 113 R, 24/113 MP, 90 A, 90 B, 453; 29/243.25, 445, 715; 227/15, 130

[56] References Cited

U.S. PATENT DOCUMENTS

| | | | |
|---|---|---|---|
| 553,938 | 2/1896 | Reichelt | 24/107 |
| 562,859 | 6/1896 | Smith | 227/15 |
| 2,835,948 | 5/1958 | Blake | 24/108 |
| 3,500,507 | 3/1970 | Malhenzie et al. | 24/113 MP |
| 3,517,874 | 6/1970 | Cressy | 227/15 |
| 3,644,965 | 2/1972 | Kahn | 24/108 |
| 3,973,296 | 8/1976 | Peterson | 24/113 MP |
| 4,035,874 | 7/1977 | Liljendahl | 24/113 MP |
| 4,457,050 | 7/1984 | Kanzaka | 24/108 |
| 4,475,273 | 10/1984 | Konno | 24/108 |
| 4,541,148 | 9/1985 | Watanabe | 24/108 |

FOREIGN PATENT DOCUMENTS

| | | | |
|---|---|---|---|
| 408236 | 5/1940 | Fed. Rep. of Germany | 227/15 |
| 359687 | 10/1931 | United Kingdom | 227/15 |
| 867888 | 5/1961 | United Kingdom | 24/108 |

*Primary Examiner*—Victor N. Sakran

*Attorney, Agent, or Firm*—Hill, Van Santen, Steadman & Simpson

[57] ABSTRACT

A domed cap button collet and the method and apparatus for the manufacture of same by deforming a flat domed button collet having an elastic body including: a shank; a radially extending plate-like flange located one end of the shank; and, a cap formed of malleable material overlying the outer surface of the flange and crimped to the peripheral portion of the flange. Pressure is simultaneously applied to bend the flange and cap member into a substantially convex dome shape. Upon removal of the pressure, the cap member retains its dome shape and the flange member reverts to its original plate-like configuration.

16 Claims, 1 Drawing Sheet

BUTTON COLLET AND METHOD AND APPARATUS FOR MAKING THE SAME

BACKGROUND OF THE INVENTION

1. Field of the Invention:

The invention relates to a button collet having a domed cap and the method and apparatus for the manufacture of the same.

2. Description of the Prior Art:

A variety of buttons are in use which comprise a button collet and a tack member adapted to be joined together to form a button when attached to a compliant material such as a garment fabric. Generally, the cap or head, of the button carries a design on its surface face to serve as either an ornamental decoration, or an aid to grasping the button and inserting the same through a button hole of a garment. Further, the head of the button appears in at least two different forms e.g.: flat or domed. A button having a substantially flat surface on its face is shown in U.S. Pat. No. 4,457,050 where a decorative disk is mounted to the surface in engagement with the base plate of the collet. U.S. Pat. No. 4,475,273 illustrates a domed button in which the front piece is crimped to embrace the periphery of ? the back piece of the button collet. Both flat and domed buttons are used depending on the styling or utilitarian needs of the customer and the manufacturer must be prepared to quickly supply those needs.

A major problem is thus evident as both flat and domed buttons must be carried in inventory so that a ready supply of buttons is immediately available all carrying the appropriate information on the button face.

As described hereinafter, the button collet of the subject invention is constructed with a minimum of structural elements whose cap can be readily and easily changed from a flat configuration to a domed configuration.

SUMMARY OF THE INVENTION

The invention is summarized as a domed button collet, and the method and apparatus for making the same, that includes: an elastic body, having a shank member and a plate-like flange member located at one end thereof; and, a cap member, overlying the outer surface of said flange member and secured to the peripheral edge portion of the flange member, the flange and cap member being deformed by the application of pressure to simultaneously bend the flange and cap members into a substantially convex dome shape such that upon removal of pressure, the cap member retains its dome shape and the flange member reverts to its original plate-like configuration.

An object of this invention is a button collet having a cap member that can be readily formed with a domed configuration.

Another object of this invention is a button collet that can be simultaneously attached to an article and have its cap deformed into a domed shape.

One advantage of the invention in that button collets can be manufactured in a uniform configuration but can be attached to an article with either a flat or a domed cap.

Other objects, advantages and features of the invention will be apparent from the following description of the preferred embodiments taken in conjunction with the accompanying drawings.

DESCRIPTION OF THE PREFERRED EMBODIMENT

Figure 1:
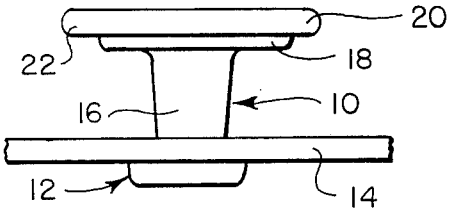
FIG. 1 is a side elevational view of a button having a flat faced cap embodying the present invention secured to a sheet of compliant material 1 by a rivet.

The present invention is particularly useful when embodied in a button collet 10 as shown in FIG. 1, attached by a rivet 12 to a sheet of compliant material, such as fabric 14, interposed therebetween, to form a button.

Button collet 16, formed from an elastic material, includes a shank 16 and a plate-like flange member 18; and, a cap 20 formed from a malleable material, such as metal or plastic, which can be permanently formed under pressure in a punch operation from a flat sheet to the curved domed cap. As shown in FIG. 1, cap 20 has its outer peripheral portion 22 crimped under the flange 18 of collet 10 to permanently secure cap 20 thereto. Shank member 16 of collet 10 spaces cap 20 and flange 18 above the upper surface of fabric 14.

Figure 2:
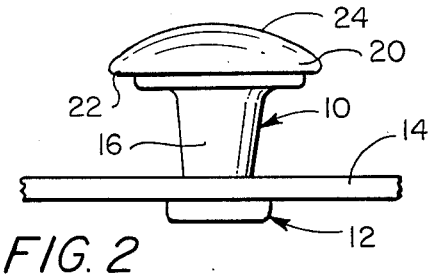
FIG. 2 is a view similar to FIG. 1 showing a button having a domed cap.

FIG. 2 illustrates another embodiment of a button in which cap 20 is similarly secured to collet 10 and has a convex dome shape configuration at 24. A particular design or ornamentation can be embossed or otherwise placed on cap 20, in each instance, to provide product identification or as an aid to grasping the button.

Figure 3:
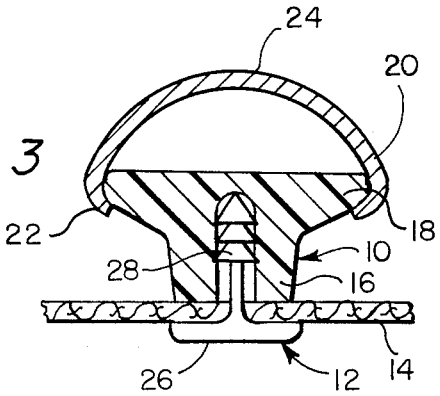
FIG. 3 is enlarged sectional view of FIG. 2.

A domed button collet 10 is shown in FIG. 3, and more clearly illustrates how the peripheral portion 22 of cap 20 is turned under and crimped onto flange 18 to permanently secure cap 20 to collet 10. While for purposes of illustration, the button collet 10 and its flange 18 and cap 20 appear to be circular in configuration, when viewed from above, the button can assume any configuration e.g.: square, octagonal, etc., and still be included in this invention. A tack 12 having a head 26 and a pronged member 28 secures button collet 18 to material 14. The outer peripheral portion of flange 18 extends radially outward from shank 16 and provides a lip on which cap 20 can be crimped to support the same.

Figure 4:
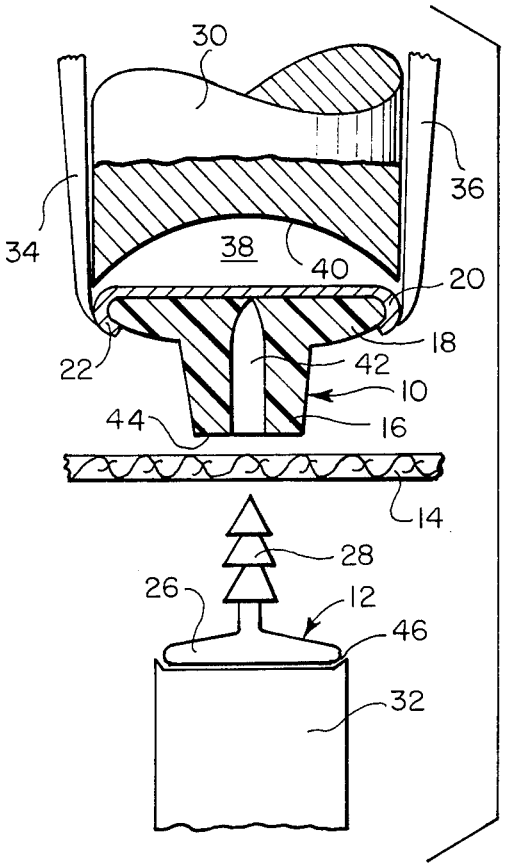
FIG. 4 is a diagrammatical view, partly in section, of the apparatus for securing the button collet and tack to a sheet of compliant material.
Figure 5:
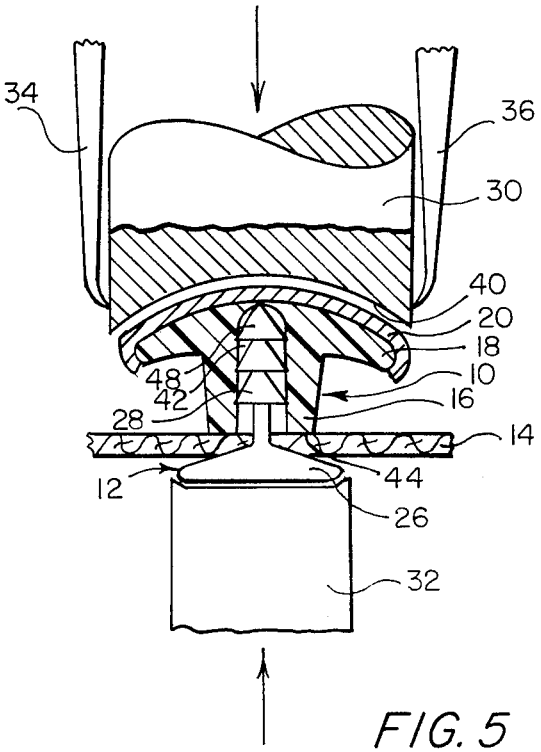
FIG. 5 is a diagrammatical view similar to FIG. 4 and showing attachment of the button collet and tack to sheet material and simultaneous a domed collet; and, FIG. 6 is a diagrammatical view, partly in section, of another embodiment of apparatus for forming a domed collet.

As shown in FIGS. 4 and 5, the apparatus for converting a flat head button to a domed head button includes a punch 30 and a ram 32 both mounted and positioned to move towards each other along the same axis in a manner known in the art, and better illustrated and described in a patent to Schmidt et al, U.S. Pat. No. 3,803,698. Button collet 10 and tack 12 are fed from respective storage supply containers (not shown) to be positioned relative to punch 30 and ram 32, respectively. Arms 34 and 36 hold collet 10 in position on punch 30 until the apparatus is actuated. Also, collet 10 and tack 12 can be hand fed to punch 30 and ram 32, respectively. Punch 30 includes a concave surface 40 which forms a recess 38 that subtends the diameter of cap 20 including peripheral portion 22 of cap 20 crimped about the edge of flange 18. Arms 34 and 36 initially support collet 10 in recess 38 but on the downstroke of punch 30 are moved out of engagement in a known manner. An opening 42 is centrally located in shank 16 and projects upwardly from bottom surface 44 of collet 10.

Tack 12 is carried in recess 46 of ram 32 and is positioned beneath mat®rial 14, with pronged member 28 positioned to enter opening 42 of collet 10. The longitudinal axis of opening 42 and pronged member 28 is the same as punch 30 and ram 32.

As shown in FIG. 5, when the attaching equipment is actuated, ram 32 moves upwardly and pronged member 28 of tack 12 moves to pierce material 14 and enters opening 42 of collet 10. Simultaneous, with the upward movement of ram 32, punch 30 descends carrying collet 10 with it until the bottom surface 44 of shank 16 engages material 14. Tip 48 of pronged member 28 now pierces material 14 and enters opening 42.

The downward movement of punch 30 drives the outer peripheral portions of cap 20 and elastic flange 18 of collet 10 further downward, whereby cap 20 and flange 18 are acted upon by concave surface 40 of punch 30, to assume a convex domed shape.

Tack 12 continues its upward movement until pronged member 28 is fully seated in opening 42 at which time head 26 prevents further upward movement as material 14 is captured between bottom surface 44 of collet 10 and head 26 of tack 12.

When punch 30 is retracted at the and of its cycle, and the pressure exerted thereby is removed, cap 20 retains its convex shape, whereas flange 18 reverts to its generally flat original shape as shown in FIG. 3.

Figure 6:
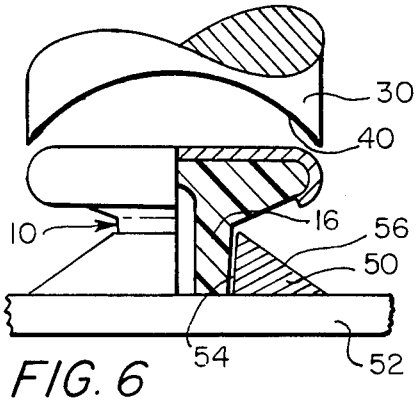

Another embodiment of the invention is illustrated in FIG. 6 wherein a older 50 secured by means such as screws or clamps (not shown) is mounted to a table 52. Holder 50 has a central opening 54 which accepts shank 16 of collet 10 and maintains the collet in a vertical position with the axis of shank 16 vertical to the horizontal plane of table 52. Upper wall 56 slopes away from the uppermost end of opening 54. In a manner similar to that shown and described with reference to FIGS. 4 and 5, a punch 3 having a concave surface 40 will act on and deform flange 18 and cap 20 to generate a collet having a cap 20 with a dome configuration 24 identical to that shown in FIG. 3. Such a collet with a dome configuration can be supplied by the button manufacturer to the garment manufacturer for attachment to an article using apparatus similar to the punch and ram mechanisms shown and described above.

At present, button collets of this invention are delivered to the garment manufacturer by the button manufacturer in both the flat head form or the domed head form. Thus the garment manufacturer as well as the button manufacturer must maintain two inventories. However, by this invention, only one inventory need be maintained by both the button manufacturer is well as the garment manufacturer.

In as much as the present invention is subject to many variations, modifications and changes in detail, it is intended that all matter contained in the foregoing description o shown on accompanying drawings shall be interpreted as illustrative and not in a limiting sense.

What is claimed is:

1. A button collet comprising:

an elastic body that includes a shank member and a plate-like flange member located at one end of said shank member; and a cap member, overlying the upper surface of said flange member and secured to the peripheral edge portion of said flange member, said cap member being deformable by temporary application of pressure to simultaneously bend said cap member and said flange member into a substantially convex dome shape, said cap member retaining the dome shape configuration and said flange member reverting to its original configuration upon the removal of said pressure.

2. A button collet as claimed in claim 1 wherein said shank member has a central axis and said flange member and said cap member each lie in a plane substantially perpendicular to the central axis of said shank member with each having the same peripheral configuration.

3. A button collet as claimed in claim 2 wherein, said shank includes a central opening in the bottom having the same central axis as said shank, said opening overlies a compliant sheet material, a tack member adapted to pierce said sheet material and to be inserted into and retained in said central opening of said shank member, and said cap member deformed when said tack member pierces said compliant material and enters into and retained within said central opening of said shank member.

4. A button as claimed in claim 3 wherein said shank member is of a cylindrical shape.

5. A button collet as claimed in claim 3 wherein said flange member initially lies in a flat and continuous plane with the upper surface thereof in contact with said cap member and subsequently spaced from said cap member after the temporary application and then removal of pressure.

6. A method of forming a domed cap on a button collet comprising the steps of:

retaining in a given position an elastic collet body that includes a shank member having a central axis and a plate-like flange member located at one end of said shank member, and a cap member that overlies the surface of said flange member and is secured to the peripheral edge portion of said flange member;

moving a punch member having a concave surface along said central axis toward said collet body to engage said cap member;

simultaneously bending said cap member and said flange member into a substantially convex dome shape; and, disengaging said punch member from said cap member whereby said cap member retains a dome shape and said flange member reverts to the original plate-like configuration.

7. A method as claimed in claim 6 wherein said step of retaining includes supporting the shank member to maintain the central axis thereof in a given direction.

8. A method of forming a domed cap button during attachment to a sheet of compliant material of: a button collet, formed of elastic material, that has a shank with a central opening in one end thereof, a plate-like flange member on said shank opposite to said opening, and a cap member of malleable material overlying said flange member and secured to the peripheral edge portion of said flange member; and, a tack member having a head and a pronged member adapted to enter said opening, comprising the steps of:

locating said sheet of compliant material in given plane intermediate said collet and said tack member positioning said button collet on one side of said material beneath a punch member having a concave surface to engage said cap;

positioning said tack member over a moveable ram member on the opposite side of said material with said pronged member in coaxial alignment with said opening in said collet body;

moving said punch member and said ram member toward each other wherein said pronged member pierced said material, enters and is seated within said opening to capture said material between said shank of said collet and said head of said tack;

simultaneously bending said cap member and said flange into a substantially convex dome shape as said punch member drives said elastic button collet into engagement with said prong member;

retracting said punch member and said ram member out of contact with said collet and said tack, respectively;

whereby said cap member retains a dome shape and said flange member reverts to its original plate-like configuration.

9. A method as claimed in claim 8 including feeding individual button collets to the punch member and individual tack members to the ram member when both are retracted.

10. A method as claimed in claim 8 including supporting the button collet in said punch member and said tack in said ram member to maintain the central axis of each coaxial.

11. An apparatus for forming a domed cap on a button collet having an elastic body that includes a shank and a radially extending flange at one end of said shank, a cap member formed of malleable material overlying and crimped to the peripheral edge portion of said flange, comprising:

means supporting said button collet along a longitudinal axis, a punch member with a centrally disposed concave surface for moving along said longitudinal axis and engaging the cap member on said flange of said collet, means for actuating said punch member in a reciprocal movement to simultaneously bend under pressure said cap and said flange member into a convex some shape, whereby upon removal of said pressure, said cap member retains the dome shaped configuration and said flange member reverts to its original configuration.

12. An apparatus as claimed in claim 11 wherein said means for supporting said button collet includes a holder having a centrally disposed opening having the same longitudinal axis adapted to accept said shank.

13. An apparatus as claimed in claim 12 wherein the inner surface of said holder that encompasses said shank of said collet has a height substantially the same as the length of said shank, with the radially extending surface positioned under said flange sloping away from said upper end of said holder.

14. An apparatus as claimed in claim 13 for use with a button collet whose shank is circular in cross section wherein said holder is ring shaped with said opening accepting said shank of said collet.

15. An apparatus for forming a domed cap on a button during attachment of a button collet and a tack member to a sheet of fabric wherein: the button collet has an elastic body that includes a shank, a central opening having a longitudinal axis in one end of said shank and a radially extending flange at the other end, and a cap member formed of a malleable material overlying and crimped to the peripheral edge portion of said flange; and said tack member has a head and a pronged member adapted to enter said central opening, comprising;

reciprocable punch means for supporting said button collet on the longitudinal axis of said central opening, a concave surface on said punch means for engaging said cap member when moving said collet, reciprocable ram means for supporting said tack member on the longitudinal axis, means for actuating said punch means and said ram means to move toward each other wherein said prong member first pierces said fabric and enters and seats in said central opening of said collet, said concave surface simultaneously bending both said cap member and said flange into a substantially convex dome shape as said punch member drives said elastic button collet into engagement with said prong member of said tack member, whereby said cap member retains a dome shape and said flange member reverts to its original plate-like configuration upon the reverse reciprocable movement of both said punch means and said ram means.

16. An apparatus as claimed in claim 15 wherein said reciprocable punch means moves said collet to seat the bottom surface of said flange on the surface of said fabric, and said ram means moves so that the tip of said pronged member pierces said fabric substantially at the same time.

* * * * *